US010511074B2

(12) United States Patent
Eberhardt et al.

(10) Patent No.: US 10,511,074 B2
(45) Date of Patent: Dec. 17, 2019

(54) HIGHER SIGNAL ISOLATION SOLUTIONS FOR PRINTED CIRCUIT BOARD MOUNTED ANTENNA AND WAVEGUIDE INTERFACE

(71) Applicant: Mimosa Networks, Inc., Santa Clara, CA (US)

(72) Inventors: Paul Eberhardt, Santa Cruz, CA (US); Carlos Ramos, San Jose, CA (US)

(73) Assignee: Mimosa Networks, Inc., Santa Clara, CA (US)

( * ) Notice: Subject to any disclaimer, the term of this patent is extended or adjusted under 35 U.S.C. 154(b) by 0 days.

(21) Appl. No.: 15/863,059

(22) Filed: Jan. 5, 2018

(65) Prior Publication Data

US 2019/0214699 A1 Jul. 11, 2019

(51) Int. Cl.

| | |
|---|---|
| ***H01Q 13/06*** | (2006.01) |
| ***H01P 3/123*** | (2006.01) |
| ***H01P 3/06*** | (2006.01) |

(52) U.S. Cl.

CPC ..... *H01P 3/123* (2013.01); *H01P 3/06* (2013.01); *H01Q 13/06* (2013.01)

(58) Field of Classification Search

CPC ..... H01Q 13/06; H01P 3/123; H01P 3/06

See application file for complete search history.

(56) References Cited

U.S. PATENT DOCUMENTS

| | | | |
|---|---|---|---|
| 2,735,993 | A | 2/1956 | Humphrey |
| 3,182,129 | A | 5/1965 | Clark et al. |
| D227,476 | S | 6/1973 | Kennedy |
| 4,188,633 | A | 2/1980 | Frazita |
| 4,402,566 | A | 9/1983 | Powell et al. |
| D273,111 | S | 3/1984 | Hirata et al. |
| 4,543,579 | A | 9/1985 | Teshirogi |
| 4,562,416 | A | 12/1985 | Sedivec |
| 4,626,863 | A | 12/1986 | Knop et al. |
| 4,835,538 | A | 5/1989 | McKenna et al. |
| 4,866,451 | A | 9/1989 | Chen |
| 4,893,288 | A | 1/1990 | Maier et al. |

(Continued)

FOREIGN PATENT DOCUMENTS

| | | | |
|---|---|---|---|
| CN | 104335654 | A | 2/2015 |
| CN | 303453662 | S | 11/2015 |

(Continued)

OTHER PUBLICATIONS

"International Search Report" and "Written Opinion of the International Search Authority," dated Nov. 26, 2013 in Patent Cooperation Treaty Application No. PCT/US2013/047406, filed Jun. 24, 2013, 9 pages.

(Continued)

*Primary Examiner* — Graham P Smith
(74) *Attorney, Agent, or Firm* — Carr & Ferrell LLP

(57) ABSTRACT

Higher isolation solutions for printed circuit board mounted antenna and waveguide interfaces are provided herein. An example device includes any of a dielectric substrate or transmission line, an antenna mounted onto the dielectric substrate, and an elongated waveguide mounted onto the dielectric substrate so as to enclose around a periphery of the antenna and contain radiation produced by the antenna along a path that is coaxial with a centerline of the waveguide, the elongated waveguide having a first cross sectional area and a second cross sectional area, and the first cross sectional area differs from the second cross sectional area.

17 Claims, 6 Drawing Sheets

(56) References Cited

U.S. PATENT DOCUMENTS 4,903,033 A 2/1990 Tsao et al.
4,986,764 A 1/1991 Eaby et al.
5,015,195 A 5/1991 Piriz
5,226,837 A 7/1993 Cinibulk et al.
5,231,406 A 7/1993 Sreenivas
D346,598 S 5/1994 McCay et al.
D355,416 S 2/1995 McCay et al.
5,389,941 A 2/1995 Yu
5,491,833 A 2/1996 Hamabe
5,513,380 A 4/1996 Ivanov et al.
5,539,361 A 7/1996 Davidovitz
5,561,434 A 10/1996 Yamazaki
D375,501 S 11/1996 Lee et al.
5,580,264 A 12/1996 Aoyama et al.
5,684,495 A 11/1997 Dyott et al.
D389,575 S 1/1998 Grasfield et al.
5,724,666 A 3/1998 Dent
5,742,911 A 4/1998 Dumbrill et al.
5,746,611 A 5/1998 Brown et al.
5,764,696 A 6/1998 Barnes et al.
5,831,582 A 11/1998 Muhlhauser et al.
5,966,102 A 10/1999 Runyon
6,014,372 A 1/2000 Kent et al.
6,067,053 A 5/2000 Runyon et al.
6,137,449 A 10/2000 Kildal
6,140,962 A 10/2000 Groenenboom
6,176,739 B1 1/2001 Denlinger et al.
6,216,266 B1 4/2001 Eastman et al.
6,271,802 B1 8/2001 Clark et al.
6,304,762 B1 10/2001 Myers et al.
D455,735 S 4/2002 Winslow
6,421,538 B1 7/2002 Byrne
6,716,063 B1 4/2004 Bryant et al.
6,754,511 B1 6/2004 Halford et al.
6,847,653 B1 1/2005 Smiroldo
D501,848 S 2/2005 Uehara et al.
6,877,277 B2 4/2005 Kussel et al.
6,962,445 B2 11/2005 Zimmel et al.
7,075,492 B1 7/2006 Chen et al.
D533,899 S 12/2006 Ohashi et al.
7,173,570 B1 2/2007 Wensink et al.
7,187,328 B2 3/2007 Tanaka et al.
7,193,562 B2 3/2007 Shtrom et al.
7,212,162 B2 5/2007 Jung et al.
7,212,163 B2 5/2007 Huang et al.
7,245,265 B2 7/2007 Kienzle et al.
7,253,783 B2 8/2007 Chiang et al.
7,264,494 B2 9/2007 Kennedy et al.
7,281,856 B2 10/2007 Grzegorzewska et al.
7,292,198 B2 11/2007 Shtrom et al.
7,306,485 B2 12/2007 Masuzaki
7,324,057 B2 1/2008 Argaman et al.
D566,698 S 4/2008 Choi et al.
7,362,236 B2 4/2008 Hoiness
7,369,095 B2 5/2008 Hirtzlin et al.
7,380,984 B2 6/2008 Wuester
7,431,602 B2 10/2008 Corona
7,498,896 B2 3/2009 Shi
7,498,996 B2 3/2009 Shtrom et al.
7,507,105 B1 3/2009 Peters et al.
7,522,095 B1 4/2009 Wasiewicz et al.
7,542,717 B2 6/2009 Green, Sr. et al.
7,581,976 B2 9/2009 Liepold et al.
7,586,891 B1 9/2009 Masciulli
7,616,959 B2 11/2009 Spenik et al.
7,675,473 B2 3/2010 Kienzle et al.
7,726,997 B2 6/2010 Kennedy et al.
7,778,226 B2 8/2010 Rayzman et al.
7,857,523 B2 12/2010 Masuzaki
7,929,914 B2 4/2011 Tegreene
RE42,522 E 7/2011 Zimmel et al.
8,009,646 B2 8/2011 Lastinger et al.
8,069,465 B1 11/2011 Bartholomay et al.
8,111,678 B2 2/2012 Lastinger et al.
8,270,383 B2 9/2012 Lastinger et al.
8,325,695 B2 12/2012 Lastinger et al.
D674,787 S 1/2013 Tsuda et al.
8,345,651 B2 1/2013 Lastinger et al.
8,482,478 B2 7/2013 Hartenstein
8,515,434 B1 8/2013 Narendran et al.
8,515,495 B2 8/2013 Shang et al.
D694,740 S 12/2013 Apostolakis
8,777,660 B2 7/2014 Chiarelli et al.
8,792,759 B2 7/2014 Benton et al.
8,827,729 B2 9/2014 Gunreben et al.
8,836,601 B2 9/2014 Sanford et al.
8,848,389 B2 9/2014 Kawamura et al.
8,870,069 B2 10/2014 Bellows
8,935,122 B2 1/2015 Stisser
9,001,689 B1 4/2015 Hinman et al.
9,019,874 B2 4/2015 Choudhury et al.
9,077,071 B2 7/2015 Shtrom et al.
9,107,134 B1 8/2015 Belser et al.
9,130,305 B2 9/2015 Ramos et al.
9,161,387 B2 10/2015 Fink et al.
9,179,336 B2 11/2015 Fink et al.
9,191,081 B2 11/2015 Hinman et al.
D752,566 S 3/2016 Hinman et al.
9,295,103 B2 3/2016 Fink et al.
9,362,629 B2 6/2016 Hinman et al.
9,391,375 B1 7/2016 Bales et al.
9,407,012 B2 8/2016 Shtrom et al.
9,431,702 B2 8/2016 Hartenstein
9,504,049 B2 11/2016 Hinman et al.
9,531,114 B2 12/2016 Ramos et al.
9,537,204 B2 1/2017 Cheng et al.
9,577,340 B2 2/2017 Fakharzadeh et al.
9,693,388 B2 6/2017 Fink et al.
9,780,892 B2 10/2017 Hinman et al.
9,843,940 B2 12/2017 Hinman et al.
9,871,302 B2 1/2018 Hinman et al.
9,888,485 B2 2/2018 Hinman et al.
9,930,592 B2 3/2018 Hinman
9,949,147 B2 4/2018 Hinman et al.
9,986,565 B2 5/2018 Fink et al.
9,998,246 B2 6/2018 Hinman et al.
10,090,943 B2 10/2018 Hinman et al.
10,096,933 B2 10/2018 Ramos et al.
10,117,114 B2 10/2018 Hinman et al.
10,186,786 B2 1/2019 Hinman et al.
10,200,925 B2 2/2019 Hinman
10,257,722 B2 4/2019 Hinman et al.
10,425,944 B2 9/2019 Fink et al.
2001/0033600 A1 10/2001 Yang et al.
2002/0102948 A1 8/2002 Stanwood et al.
2002/0159434 A1 10/2002 Gosior et al.
2003/0013452 A1 1/2003 Hunt et al.
2003/0027577 A1 2/2003 Brown et al.
2003/0169763 A1 9/2003 Choi et al.
2003/0222831 A1 12/2003 Dunlap
2003/0224741 A1 12/2003 Sugar et al.
2004/0002357 A1 1/2004 Benveniste
2004/0029549 A1 2/2004 Fikart
2004/0110469 A1 6/2004 Judd et al.
2004/0120277 A1 6/2004 Holur et al.
2004/0196812 A1 10/2004 Barber
2004/0196813 A1 10/2004 Ofek et al.
2004/0240376 A1 12/2004 Wang et al.
2004/0242274 A1 12/2004 Corbett et al.
2005/0032479 A1 2/2005 Miller et al.
2005/0058111 A1 3/2005 Hung et al.
2005/0124294 A1 6/2005 Wentink
2005/0143014 A1 6/2005 Li et al.
2005/0195758 A1 9/2005 Chitrapu
2005/0227625 A1 10/2005 Diener
2005/0254442 A1 11/2005 Proctor, Jr. et al.
2005/0271056 A1 12/2005 Kaneko
2005/0275527 A1 12/2005 Kates
2006/0025072 A1 2/2006 Pan
2006/0072518 A1 4/2006 Pan et al.
2006/0098592 A1 5/2006 Proctor, Jr. et al.
2006/0099940 A1 5/2006 Pfleging et al.
2006/0132359 A1 6/2006 Chang et al.
2006/0132602 A1 6/2006 Muto et al.

(56) References Cited

U.S. PATENT DOCUMENTS

| | | | |
|---|---|---|---|
| 2006/0172578 | A1 | 8/2006 | Parsons |
| 2006/0187952 | A1 | 8/2006 | Kappes et al. |
| 2006/0211430 | A1 | 9/2006 | Persico |
| 2007/0001910 | A1 | 1/2007 | Yamanaka et al. |
| 2007/0019664 | A1 | 1/2007 | Benveniste |
| 2007/0035463 | A1 | 2/2007 | Hirabayashi |
| 2007/0060158 | A1 | 3/2007 | Medepalli et al. |
| 2007/0132643 | A1 | 6/2007 | Durham et al. |
| 2007/0173199 | A1 | 7/2007 | Sinha |
| 2007/0173260 | A1 | 7/2007 | Love et al. |
| 2007/0202809 | A1 | 8/2007 | Lastinger et al. |
| 2007/0210974 | A1 | 9/2007 | Chiang |
| 2007/0223701 | A1 | 9/2007 | Emeott et al. |
| 2007/0238482 | A1 | 10/2007 | Rayzman et al. |
| 2007/0255797 | A1 | 11/2007 | Dunn et al. |
| 2007/0268848 | A1 | 11/2007 | Khandekar et al. |
| 2008/0109051 | A1 | 5/2008 | Splinter et al. |
| 2008/0112380 | A1 | 5/2008 | Fischer |
| 2008/0192707 | A1 | 8/2008 | Xhafa et al. |
| 2008/0218418 | A1 | 9/2008 | Gillette |
| 2008/0231541 | A1 | 9/2008 | Teshirogi et al. |
| 2008/0242342 | A1 | 10/2008 | Rofougaran |
| 2009/0046673 | A1 | 2/2009 | Kaidar |
| 2009/0052362 | A1 | 2/2009 | Meier et al. |
| 2009/0059794 | A1 | 3/2009 | Frei |
| 2009/0075606 | A1 | 3/2009 | Shtrom et al. |
| 2009/0096699 | A1 | 4/2009 | Chiu et al. |
| 2009/0232026 | A1 | 9/2009 | Lu |
| 2009/0233475 | A1 | 9/2009 | Mildon et al. |
| 2009/0291690 | A1 | 11/2009 | Guvenc et al. |
| 2009/0315792 | A1 | 12/2009 | Miyashita et al. |
| 2010/0029282 | A1 | 2/2010 | Stamoulis et al. |
| 2010/0039340 | A1 | 2/2010 | Brown |
| 2010/0046650 | A1 | 2/2010 | Jongren et al. |
| 2010/0067505 | A1 | 3/2010 | Fein et al. |
| 2010/0085950 | A1 | 4/2010 | Sekiya et al. |
| 2010/0091818 | A1 | 4/2010 | Sen et al. |
| 2010/0103065 | A1 | 4/2010 | Shtrom et al. |
| 2010/0103066 | A1 | 4/2010 | Shtrom et al. |
| 2010/0136978 | A1 | 6/2010 | Cho et al. |
| 2010/0151877 | A1 | 6/2010 | Lee et al. |
| 2010/0167719 | A1 | 7/2010 | Sun et al. |
| 2010/0171665 | A1 | 7/2010 | Nogami |
| 2010/0171675 | A1 | 7/2010 | Borja et al. |
| 2010/0189005 | A1 | 7/2010 | Bertani et al. |
| 2010/0202613 | A1 | 8/2010 | Ray et al. |
| 2010/0210147 | A1 | 8/2010 | Hauser |
| 2010/0216412 | A1 | 8/2010 | Rofougaran |
| 2010/0225529 | A1 | 9/2010 | Landreth et al. |
| 2010/0238083 | A1 | 9/2010 | Malasani |
| 2010/0315307 | A1 | 12/2010 | Syed et al. |
| 2010/0322219 | A1 | 12/2010 | Fischer et al. |
| 2011/0006956 | A1 | 1/2011 | McCown |
| 2011/0028097 | A1 | 2/2011 | Memik et al. |
| 2011/0032159 | A1 | 2/2011 | Wu et al. |
| 2011/0044186 | A1 | 2/2011 | Jung et al. |
| 2011/0103309 | A1 | 5/2011 | Wang et al. |
| 2011/0111715 | A1 | 5/2011 | Buer et al. |
| 2011/0112717 | A1 | 5/2011 | Resner |
| 2011/0133996 | A1 | 6/2011 | Alapuranen |
| 2011/0170424 | A1 | 7/2011 | Safavi |
| 2011/0172916 | A1 | 7/2011 | Pakzad et al. |
| 2011/0182260 | A1 | 7/2011 | Sivakumar et al. |
| 2011/0182277 | A1 | 7/2011 | Shapira |
| 2011/0194644 | A1 | 8/2011 | Liu et al. |
| 2011/0206012 | A1 | 8/2011 | Youn et al. |
| 2011/0241969 | A1 | 10/2011 | Zhang et al. |
| 2011/0243291 | A1 | 10/2011 | McAllister et al. |
| 2011/0256874 | A1 | 10/2011 | Hayama et al. |
| 2011/0291914 | A1 | 12/2011 | Lewry et al. |
| 2012/0008542 | A1 | 1/2012 | Koleszar et al. |
| 2012/0040700 | A1 | 2/2012 | Gomes et al. |
| 2012/0057533 | A1 | 3/2012 | Junell et al. |
| 2012/0093091 | A1 | 4/2012 | Kang et al. |
| 2012/0115487 | A1 | 5/2012 | Josso |
| 2012/0134280 | A1 | 5/2012 | Rotvold et al. |
| 2012/0140651 | A1 | 6/2012 | Nicoara et al. |
| 2012/0238201 | A1 | 9/2012 | Du et al. |
| 2012/0263145 | A1 | 10/2012 | Marinier et al. |
| 2012/0282868 | A1 | 11/2012 | Hahn |
| 2012/0299789 | A1 | 11/2012 | Orban et al. |
| 2012/0314634 | A1 | 12/2012 | Sekhar |
| 2013/0003645 | A1 | 1/2013 | Shapira et al. |
| 2013/0005350 | A1 | 1/2013 | Campos et al. |
| 2013/0023216 | A1 | 1/2013 | Moscibroda et al. |
| 2013/0064161 | A1 | 3/2013 | Hedayat et al. |
| 2013/0082899 | A1 | 4/2013 | Gomi |
| 2013/0095747 | A1 | 4/2013 | Moshfeghi |
| 2013/0128858 | A1 | 5/2013 | Zou et al. |
| 2013/0176902 | A1 | 7/2013 | Wentink et al. |
| 2013/0182652 | A1 | 7/2013 | Tong et al. |
| 2013/0195081 | A1 | 8/2013 | Merlin et al. |
| 2013/0210457 | A1 | 8/2013 | Kummetz |
| 2013/0223398 | A1 | 8/2013 | Li et al. |
| 2013/0234898 | A1 | 9/2013 | Leung et al. |
| 2013/0271319 | A1 | 10/2013 | Trerise |
| 2013/0286950 | A1 | 10/2013 | Pu |
| 2013/0286959 | A1 | 10/2013 | Lou et al. |
| 2013/0288735 | A1 | 10/2013 | Guo |
| 2013/0301438 | A1 | 11/2013 | Li et al. |
| 2013/0322276 | A1 | 12/2013 | Pelletier et al. |
| 2013/0322413 | A1 | 12/2013 | Pelletier et al. |
| 2014/0024328 | A1 | 1/2014 | Balbien et al. |
| 2014/0051357 | A1 | 2/2014 | Steer et al. |
| 2014/0098748 | A1 | 4/2014 | Chan et al. |
| 2014/0113676 | A1 | 4/2014 | Hamalainen et al. |
| 2014/0145890 | A1 | 5/2014 | Ramberg et al. |
| 2014/0185494 | A1 | 7/2014 | Yang et al. |
| 2014/0191918 | A1 | 7/2014 | Cheng et al. |
| 2014/0198867 | A1 | 7/2014 | Sturkovich et al. |
| 2014/0206322 | A1 | 7/2014 | Dimou et al. |
| 2014/0225788 | A1 | 8/2014 | Schulz et al. |
| 2014/0233613 | A1 | 8/2014 | Fink et al. |
| 2014/0235244 | A1 | 8/2014 | Hinman |
| 2014/0253378 | A1 | 9/2014 | Hinman |
| 2014/0253402 | A1 | 9/2014 | Hinman et al. |
| 2014/0254700 | A1 | 9/2014 | Hinman et al. |
| 2014/0256166 | A1 | 9/2014 | Ramos et al. |
| 2014/0320306 | A1 | 10/2014 | Winter |
| 2014/0320377 | A1 | 10/2014 | Cheng et al. |
| 2014/0328238 | A1 | 11/2014 | Seok et al. |
| 2014/0355578 | A1 | 12/2014 | Fink et al. |
| 2014/0355584 | A1 | 12/2014 | Fink et al. |
| 2015/0002335 | A1 | 1/2015 | Hinman et al. |
| 2015/0002354 | A1 | 1/2015 | Knowles |
| 2015/0015435 | A1 | 1/2015 | Shen et al. |
| 2015/0116177 | A1 | 4/2015 | Powell et al. |
| 2015/0215952 | A1 | 7/2015 | Hinman et al. |
| 2015/0256275 | A1 | 9/2015 | Hinman et al. |
| 2015/0263816 | A1 | 9/2015 | Hinman et al. |
| 2015/0319584 | A1 | 11/2015 | Fink et al. |
| 2015/0321017 | A1 | 11/2015 | Perryman et al. |
| 2015/0325945 | A1 | 11/2015 | Ramos et al. |
| 2015/0327272 | A1 | 11/2015 | Fink et al. |
| 2015/0365866 | A1 | 12/2015 | Hinman et al. |
| 2016/0119018 | A1 | 4/2016 | Lindgren et al. |
| 2016/0149634 | A1 | 5/2016 | Kalkunte et al. |
| 2016/0149635 | A1 | 5/2016 | Hinman et al. |
| 2016/0211583 | A1 | 7/2016 | Lee et al. |
| 2016/0240929 | A1 | 8/2016 | Hinman et al. |
| 2016/0338076 | A1 | 11/2016 | Hinman et al. |
| 2016/0365666 | A1 | 12/2016 | Ramos et al. |
| 2016/0366601 | A1 | 12/2016 | Hinman et al. |
| 2017/0048647 | A1 | 2/2017 | Jung et al. |
| 2017/0201028 | A1 | 7/2017 | Eberhardt et al. |
| 2017/0238151 | A1 | 8/2017 | Fink et al. |
| 2017/0294975 | A1 | 10/2017 | Hinman et al. |
| 2018/0034166 | A1 | 2/2018 | Hinman |
| 2018/0035317 | A1 | 2/2018 | Hinman et al. |
| 2018/0083365 | A1 | 3/2018 | Hinman et al. |
| 2018/0084563 | A1 | 3/2018 | Hinman et al. |
| 2018/0160353 | A1 | 6/2018 | Hinman |
| 2018/0192305 | A1 | 7/2018 | Hinman et al. |
| 2018/0199345 | A1 | 7/2018 | Fink et al. |

(56) References Cited

U.S. PATENT DOCUMENTS

| | | | |
|---|---|---|---|
| 2018/0241491 | A1 | 8/2018 | Hinman et al. |
| 2019/0006789 | A1 | 1/2019 | Ramos et al. |
| 2019/0182686 | A1 | 6/2019 | Hinman et al. |
| 2019/0215745 | A1 | 7/2019 | Hinman |
| 2019/0273326 | A1 | 9/2019 | Sanford et al. |

FOREIGN PATENT DOCUMENTS

| | | | |
|---|---|---|---|
| CN | 105191204 | A | 12/2015 |
| CN | 105191204 | B | 5/2019 |
| EM | 002640177 | | 2/2015 |
| EP | 1384285 | B1 | 6/2007 |
| WO | WO2014137370 | A1 | 9/2014 |
| WO | WO2014138292 | A1 | 9/2014 |
| WO | WO2014193394 | A1 | 12/2014 |
| WO | WO2015112627 | A1 | 7/2015 |
| WO | WO2017123558 | A1 | 7/2017 |
| WO | WO2018022526 | A1 | 2/2018 |
| WO | W02019136257A1 | A1 | 7/2019 |
| WO | W02019168800 | A1 | 9/2019 |

OTHER PUBLICATIONS

"International Search Report" and "Written Opinion of the International Search Authority," dated Aug. 9, 2013 in Patent Cooperation Treaty Application No. PCT/US2013/043436, filed May 30, 2013, 13 pages.

"International Search Report" and "Written Opinion of the International Search Authority," dated Jul. 1, 2014 in Patent Cooperation Treaty Application No. PCT/US2014/020880, filed Mar. 5, 2014, 14 pages.

"International Search Report" and "Written Opinion of the International Search Authority," dated Jun. 29, 2015 in Patent Cooperation Treaty Application No. PCT/US2015/012285, filed Jan. 21, 2015, 15 pages.

Hinman et al., U.S. Appl. No. 61/774,632, filed Mar. 7, 2013, 23 pages.

Office Action dated Jun. 15, 2015 in Chinese Design Patent Application 201530058063.8, filed Mar. 11, 2015, 1 page.

Notice of Allowance dated Sep. 8, 2015 in Chinese Design Patent Application 201530058063.8, filed Mar. 11, 2015, 3 pages.

Weisstein, Eric, "Electric Polarization", Wolfram Reasearch [online], Retrieved from the Internet [retrieved Mar. 23, 2017] <URL:http://scienceworld.wolfram.com/physics/ElectricPolarization.html>, 2007, 1 page.

Liu, Lingjia et al., "Downlink MIMO in LTE-Advanced: SU-MIMO vs. MU-MIMO," IEEE Communications Magazine, Feb. 2012, pp. 140-147.

"International Search Report" and "Written Opinion of the International Searching Authority," Patent Cooperation Treaty Application No. PCT/US2017/012884, dated Apr. 6, 2017, 9 pages.

"Office Action," Chinese Patent Application No. 201580000078.6, dated Nov. 3, 2017, 5 pages [10 pages including translation].

"International Search Report" and "Written Opinion of the International Searching Authority," Patent Cooperation Treaty Application No. PCT/US2017/043560, dated Nov. 16, 2017, 11 pages.

"International Search Report" and "Written Opinion of the International Search Authority," dated May 23, 2019 in Patent Cooperation Treaty Application No. PCT/US2019/019462, filed Feb. 25, 2019, 8 pages.

Teshirogi, Tasuku et al., "Wideband Circularly Polarized Array Antenna with Sequential Rotations and Phase Shift of Elements," Proceedings of the International Symposium on Antennas and Propagation, 1985, pp. 117-120.

"Office Action," Chinese Patent Application No. 201580000078.6, Jul. 30, 2018, 5 pages [11 pages including translation].

"Office Action," Chinese Patent Application No. 201580000078.6, Oct. 31, 2018, 3 pages [6 pages including translation].

"Notice of Allowance," Chinese Patent Application No. 201580000078.6, Feb. 11, 2019, 2 pages [4 pages including translation].

"International Search Report" and "Written Opinion of the International Search Authority," dated Mar. 22, 2019 in Patent Cooperation Treaty Application No. PCT/US2019/012358, filed Jan. 4, 2019, 9 pages.

FCC Regulations, 47 CFR § 15.407, 63 FR 40836, Jul. 31, 1998, as amended at 69 FR 2687, Jan. 20, 2004; 69 FR 54036, Sep. 7, 2004; pp. 843-846.

HIGHER SIGNAL ISOLATION SOLUTIONS FOR PRINTED CIRCUIT BOARD MOUNTED ANTENNA AND WAVEGUIDE INTERFACE

CROSS REFERENCE TO RELATED APPLICATION

This application is related to U.S. Nonprovisional application Ser. No. 15/403,085, filed on Jan. 10, 2017, which is hereby incorporated by reference herein including all references cited therein.

FIELD OF THE PRESENT DISCLOSURE

The present disclosure relates generally to transition hardware between waveguide transmission lines and printed circuit and/or coaxial transmission lines. The present disclosure describes but is not limited to higher isolation solutions utilizing certain forms of waveguides.

SUMMARY

According to some embodiments, the present disclosure is directed to a device that comprises: (a) a dielectric substrate; (b) an electrical feed; (b) an antenna mounted onto the dielectric substrate and connected to the electrical feed; and (c) an elongated waveguide mounted onto the dielectric substrate so as to enclose around a periphery of the antenna and contain radiation produced by the antenna along a path that is coaxial with a centerline of the waveguide, the elongated waveguide having a first cross sectional area and a second cross sectional area, wherein the first cross sectional area differs from the second cross sectional area.

According to some embodiments, the present disclosure is directed to a device that comprises: (a) a dielectric substrate having one or more probes; (b) an electrical feed; (b) an antenna mounted onto the dielectric substrate and connected to the electrical feed; and (c) an elongated waveguide mounted onto the dielectric substrate so as to enclose around a periphery of the antenna and contain radiation produced by the antenna along a path that is coaxial with a centerline of the waveguide, the elongated waveguide having a first cross sectional area and a second cross sectional area, wherein the first cross sectional area differs from the second cross sectional area.

In some embodiments, the one or more probes comprise wire components which have been soldered directly onto the dielectric substrate. In other embodiments, the one or more probes are inserted into the dielectric substrate. In further embodiments, the one or more probes are printed onto the dielectric substrate.

BRIEF DESCRIPTION OF THE DRAWINGS

Certain embodiments of the present technology are illustrated by the accompanying figures. It will be understood that the figures are not necessarily to scale and that details not necessary for an understanding of the technology or that render other details difficult to perceive may be omitted. It will be understood that the technology is not necessarily limited to the particular embodiments illustrated herein.

DESCRIPTION OF EXEMPLARY EMBODIMENTS

Figure 1A:
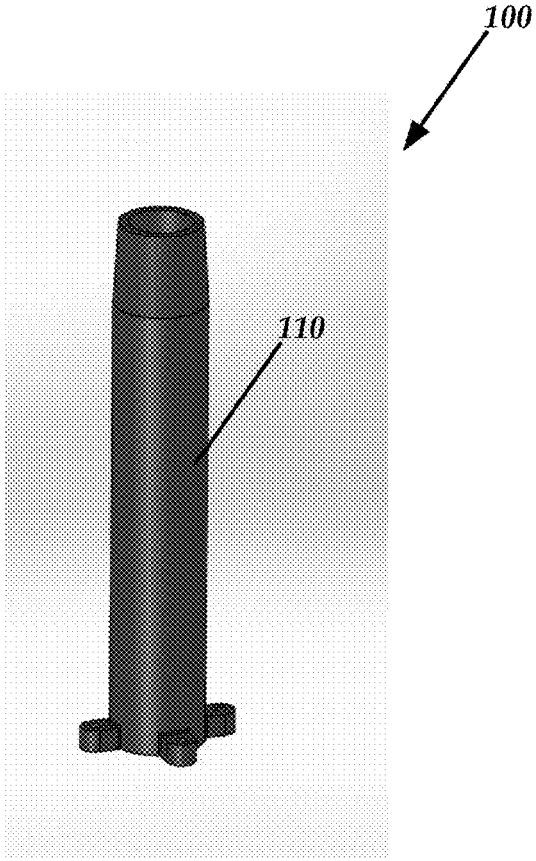
FIGS. 1A and 1B are perspective views of an example device constructed in accordance with the present disclosure.

Generally, the present disclosure provides higher polarization isolation solutions for waveguides that are mounted directly to a printed circuit board (PCB) or otherwise coupled to the PCB. Specifically, in some embodiments, the present disclosure utilizes one or more cross sections of a given waveguide to ease signal transition. Waveguides can have any variety of geometrical shapes and cross sections. The shape and/or cross section of a waveguide can be continuous along its length or can vary according to various design requirements. For instance, cross sections can be polygonal, conical, cylindrical, rectangular, elliptical square or circular, just to name a few.

The current practice is to excite a waveguide with a probe or monopole antenna. The probe can be a wire attached to a coaxial transmission or a feature embedded in a PCB. Typically, a PCB can be created with probes on the circuit board. A waveguide is then mounted directly to the PCB at approximately 90 degrees.

When probes are used to excite a waveguide, it is often convenient to place them on the same plane. In a circular waveguide, this results in limited isolation between orthogonal polarizations. A typical isolation is −20 dB using this type of configuration. One issue that arises with this practice is that electric fields inside a circular waveguide are not constrained to a particular direction as they are in a polygonal (square) waveguide. Small deviations inside the circular waveguide easily disturb the electrical field direction and thus degrade the isolation between orthogonal signals. Probes that are inserted into a circular waveguide are not symmetric and thus they disturb the otherwise orthogonal fundemental fields.

In contrast to the current practice, in some embodiments, the present disclosure provides a polygonal (square) waveguide as a transition region before the circular waveguide to improve isolation compared to what is practical with coplanar probes in a circular waveguide. Specifically, fields in a square waveguide are constrained to remain perpendicular to the waveguide walls and thus are not as free to change orientation as if they would be in a circular waveguide. The introduction of a square waveguide cross sectional area as a transition greatly improves the signal isolation that can be realized. As mentioned before, coplanar probes in a circular waveguide typically achieve −20 dB of isolation. With a square waveguide cross sectional area, signal isolation can increased to −40 dB and the signals can be much more clearly separated. In other words, 100 times improvement is achieved utilizing a square waveguide cross sectional area. The square waveguide cross sectional area resists the tendency for non-symmetric probes to cause polarization rotation which in turn increases polarization isolation. When the probes are coplanar in a circular cross sectional area there is an opportunity for the electric fields to rotate reducing cross polarization isolation. In a square waveguide the boundary condition for fields termination on the wall are held in a single plane and cannot rotate as a circular of curved wall allows.

The present disclosure provides three noteworthy features. First, the methods and systems described herein provide improved higher polarization isolation, which allows for better separation of two signals as they are transmitted in space. In other words, the two signals will interact with each other less. As mentioned earlier, higher isolation of approximately −40 dB is achieved using the embodiments of this present disclosure, which is a 100 times improvement from the current practice of −20 dB. Further details regarding this improvement will be discussed later herein.

In a second aspect, the present disclosure provides an improved matching with the addition of dialectic material (such as in a dielectric block) around the PCB launch. That is, the process works better than conventional processes because there is a gentler transition of sending signals out of the PCB launched in the waveguide and reinjecting them. To be sure, the dielectric block can be a matching component of the waveguide where it is used at the circular cross sectional area and the square cross sectional area of the waveguide. The dielectric block can be a matching component of the waveguide to match the PCB and the waveguide interface.

As a third feature of the present disclosure, various probes could be used, either in 3D or as shapes printed on a PCB. As will be explained further in this paper, in some embodiments, the dielectric filling does not need to be present. In other cases, dielectric filling can be used to support 3D probes. In further cases, the dielectric block is more convenient when it comes to precisely positioning probes inside the waveguide, which is occasionally used as a technique to supply and launch signals into the waveguide.

In some embodiments, the probes are made of wire which are soldered directly onto the circuit board and pressed in with the dielectric block. The probes could have a flatten replica right on the PCB itself. Instead of a rod shaped probe, it may be a flat piece of conductor built on the PCB. The probe can be included on the PCB on a two dimensional sheet rather than a three dimensional rod. An example of this can be viewed in FIG. 6, discussed below.

It should be noted that the present disclosure contemplates embodiments where a waveguide has a first cross sectional area and a second cross sectional area. The first cross sectional area and the second cross sectional area differ from each other. These cross sections may have different shapes, forms, types, or configurations. By having the signals pass through two separate waveguide cross sectional areas that differ from one another, the signal transition may be easier and less abrupt. These and other advantages of the present disclosure are described in greater detail infra. Further discussion regarding different types of waveguides can be found in U.S. Nonprovisional application Ser. No. 15/403,085, filed on Jan. 10, 2017, which is hereby incorporated by reference herein including all references cited therein.

Figure 1B:
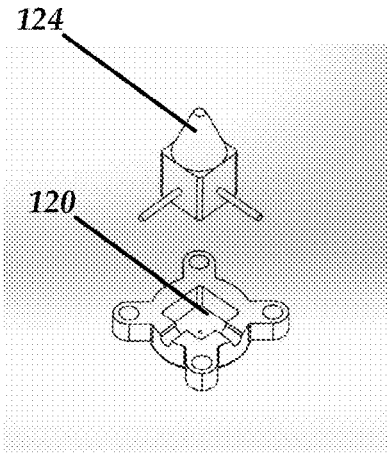

Turning now to the figures, FIGS. 1A and 1B depict an example device 100 that is constructed in accordance with the present disclosure. Specifically, these figures depict the transition where the signals are led either on or off of the PCB into the structure for the antenna (not shown). The device 100 comprises a waveguide having a circular (cylindrical) waveguide cross sectional area 110 and a square transition waveguide cross sectional area 120. The square transition waveguide cross-sectional area 120 may also include one or more connectors. The device 100 can include additional or fewer components than those illustrated.

The coaxial connectors can launch signals into the PCB (not shown in FIGS. 1A and 1B). The PCB is preferably sandwiched between the circular waveguide cross sectional area 110 and the square transition waveguide cross sectional 120. A more detailed view of this can be found in the assembly view provided in FIG. 4, which shows a PCB 420 is sandwiched in between the circular waveguide cross sectional area 110 and the square transition waveguide cross sectional 120. Further details regarding FIG. 4 and the particular components of the device are provided later herein.

Referring still to FIGS. 1A and 1B, inside the circular waveguide is a square aperture which can mate with a waveguide that has a circular aperture which has a sharp edge. A conical shaped piece 124 of dielectric in that area is used to smooth the transition.

As described earlier, the present disclosure is directed to a device that transitions signals using a waveguide including a first cross sectional area and a second cross sectional area, the first and second cross sectional areas differing from either other. In some embodiments, the first cross sectional areas has a circular or cylindrical configuration and the second waveguide has a polygonal or square configuration. In some embodiments, the waveguide can comprise two sections of different size and/or cross section from one another.

Figure 2:
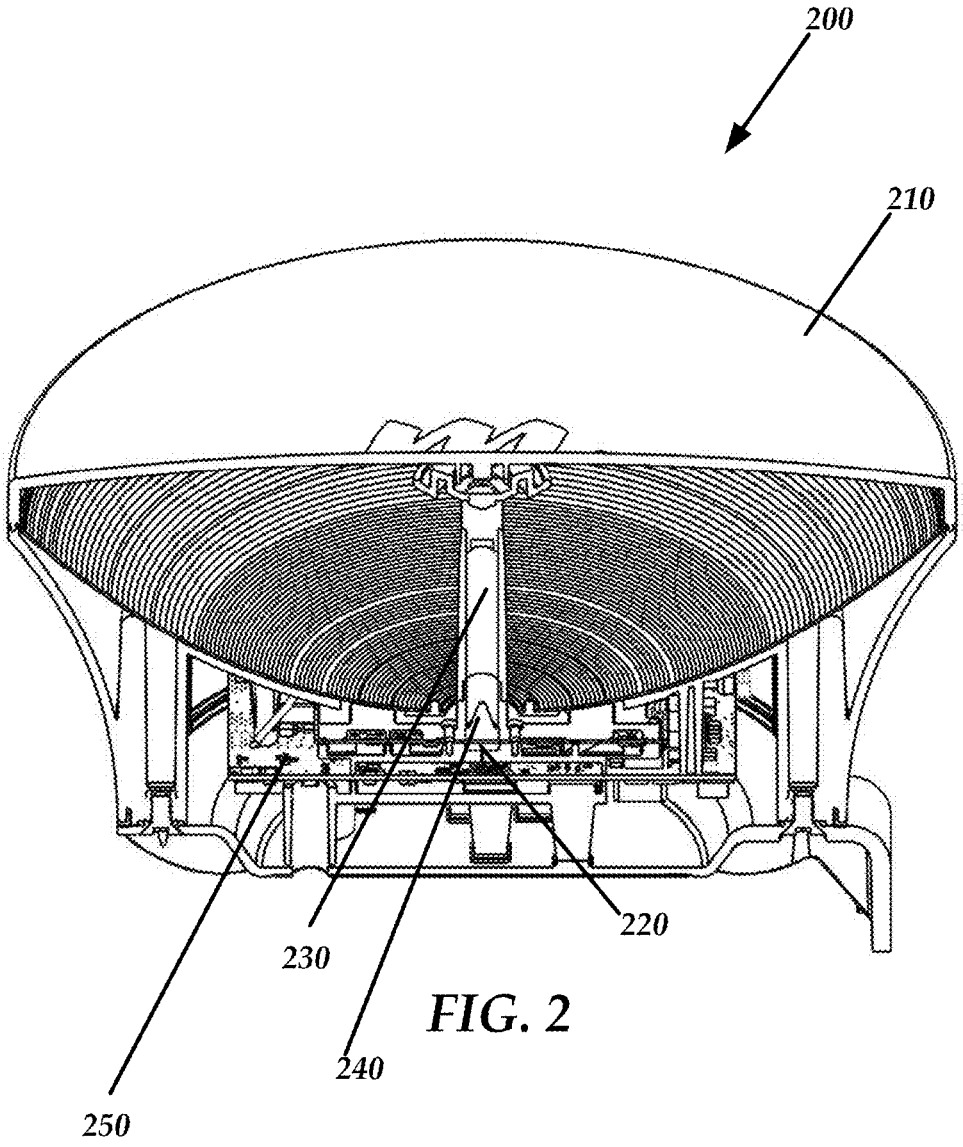
FIG. 2 is a cross sectional view of an example device constructed in accordance with the present disclosure. The example device comprises a waveguide of transitional cross section along its length, and having both a polygonal cross sectional area and a cylindrical cross sectional area. This waveguide is incorporated into a reflector antenna.

FIG. 2 provides a cross sectional view of an example device 200 constructed in accordance with the present disclosure. The device 200 comprises an integrated antenna, radio, and transceiver both for transmitting and receiving data signals. In some embodiments, the device 200 can be a 24 GHz back-haul radio. The device 200 can communicate with a similar device located miles away. In some embodiments, the antenna is approximately 255 mm in diameter and is coupled with two printed circuit transmission lines (i.e. feed strips). In various embodiments, the use of two feed lines (or feed lines and coaxial cables) allows for dual linear (or dual circular) polarization. Additional feeds could be used to excite multiple, higher order modes in a particular waveguide. Indeed, feed lines/strips as well as coaxial cables as described herein can be generally referred to as an electrical feed.

The waveguide contains radiation produced by the antenna and directs the radiation along a path that is coaxial with a centerline X of the waveguide, in some embodiments.

In some embodiments, the antenna is coupled with a coaxial cable to a signal source such as a radio. In other embodiments, the antenna is coupled to a radio with a PCB based transmission line or feed strip. In some embodiments, the coaxial cable is used in place of the feed strip. In some embodiments, the coaxial cable is used in combination with one or more feed strips. The feed strip can comprise a printed circuit transmission line, in some embodiments.

Advantageously, the device 200 provides high levels of signal isolation between adjacent feeds, in various embodiments. The device 200 can also allow for linear or circular waves to be easily directed as desired. A narrow or wide bandwidth transition can be utilized, in some embodiments.

The waveguide of the device 200 can direct energy out onto the curved surface that is a parabolic reflector 210. The dielectric substrate can comprise any suitable PCB (printed circuit board) substrate material constructed from, for example, one or more dielectric materials. The antenna is mounted onto the dielectric substrate. In one embodiment the antenna is a patch antenna. In another embodiment, the antenna is a multi-stack set of antennas. In some embodiments, the antenna is electrically coupled with one or more printed circuit transmission lines.

The example device 200 comprises a waveguide of transitional cross section along its length. The waveguide depicted has both a polygonal cross sectional 220 area and a cylindrical cross sectional area 230. In other words, the waveguide of FIG. 2 has a first section that has a polygonal cross section and a second section that has a cylindrical cross section. A transition section 240 couples the first section and the second section of the waveguide. The transition section 240 allows the shape of the signal radiation that is emitted to be changed. For example, the transition section 240 can be in the form of a square 220 with a conical shape mounted on it or otherwise coupled to it, while the waveguide includes a circular cross sectional area 230, such as illustrated in FIG. 2. Thus, in this embodiment, the square 220 is tapered into a conical shape, and allowed to gradually decrease until it disappears. This is the area where there is a transition between the propagation the polygonal cross sectional 220 area in relation to the cylindrical cross sectional area 230.

Referring still to FIG. 2, the square 220 can be a dialectic block to ease the transition from the PCB into the waveguide, and also further down, the dielectric block can be used to ease the transition between the square waveguide cross sectional area 220 and the circular waveguide cross sectional area 230. This allows for optimum radiation reflection and symmetry near the antenna, while providing a desired emitted signal shape through the transition section 240.

The waveguide contains radiation produced by the antenna and directs the radiation along a path that is coaxial with a centerline X of the waveguide, in some embodiments.

While the waveguide is generally elongated, the waveguide can comprise a truncated or short embodiment of a waveguide.

For context, without the waveguide, the antenna emits signal radiation in a plurality of directions, causing loss of signal strength, reduced signal directionality, as well as cross-port interference (e.g., where an adjacent antenna is affected by the antenna).

In various embodiments, the waveguide of the device 200 is mounted directly to the dielectric substrate 250, around a periphery of the antenna. The spacing between the waveguide and the antenna can be varied according to design parameters.

In one embodiment the waveguide encloses the antenna and captures the radiation of the antenna, directing it along and out of the waveguide. The waveguide is constructed from any suitable conductive material. The use of the waveguide allows one to transfer signals from one location to another location with minimal loss or disturbance of the signal.

In various embodiments, the length of the waveguide is selected according to design requirements, such as required signal symmetry. The waveguide can have any desired shape and/or size and length. The illustrated waveguide is circular in shape, but any polygonal, cylindrical, or irregular shape can be implemented as desired.

In various embodiments, the selection of dielectric materials for the waveguide can be used to effectively adjust a physical size of components of the device 200 while keeping the electrical characteristics compatible. Notably, a wavelength in dielectric makes objects smaller than they would be in a vacuum so the components or parts of the device 100 may shrink in size. Typically there is a sharp transition between the PCB material and the air vacuum that causes reflections instead of radiation. By placing a dielectric block on either side of the PCB, the transition is eased to ensure a gentler, less abrupt transition. In other words, this results in a less abrupt change in the propagation characteristics resulting in fewer reflections and less interference as they move throughout the device.

The present disclosure also includes embodiments where the device includes multiple dielectric pieces in different cross sections of a waveguide, in order to ease signal transition. If the signal hits the transition the amount of energy reflected in that transition corresponds to how much the dielectric constant changes on one side of the transition in comparison to the other side. Thus, the reflections are much reduced if signals experience propagation changes through are a plurality of smaller steps instead of one big step.

It also should be noted that with the appropriate thicknesses, the reflections of one transition can be arranged to cancel the reflections from a subsequent reflection. Thus, for instance, the conical shape mounted onto the square transition cross section area could vary in length, be it longer or shorter. The conical shape has a flat end with which one could control the magnitude and direction of a reflection in such a way that it cancels all the other reflections. In other words, the conical shape can be used as a tuning tool to cancel other reflections, which is an improvement above the current practice.

Figure 3:
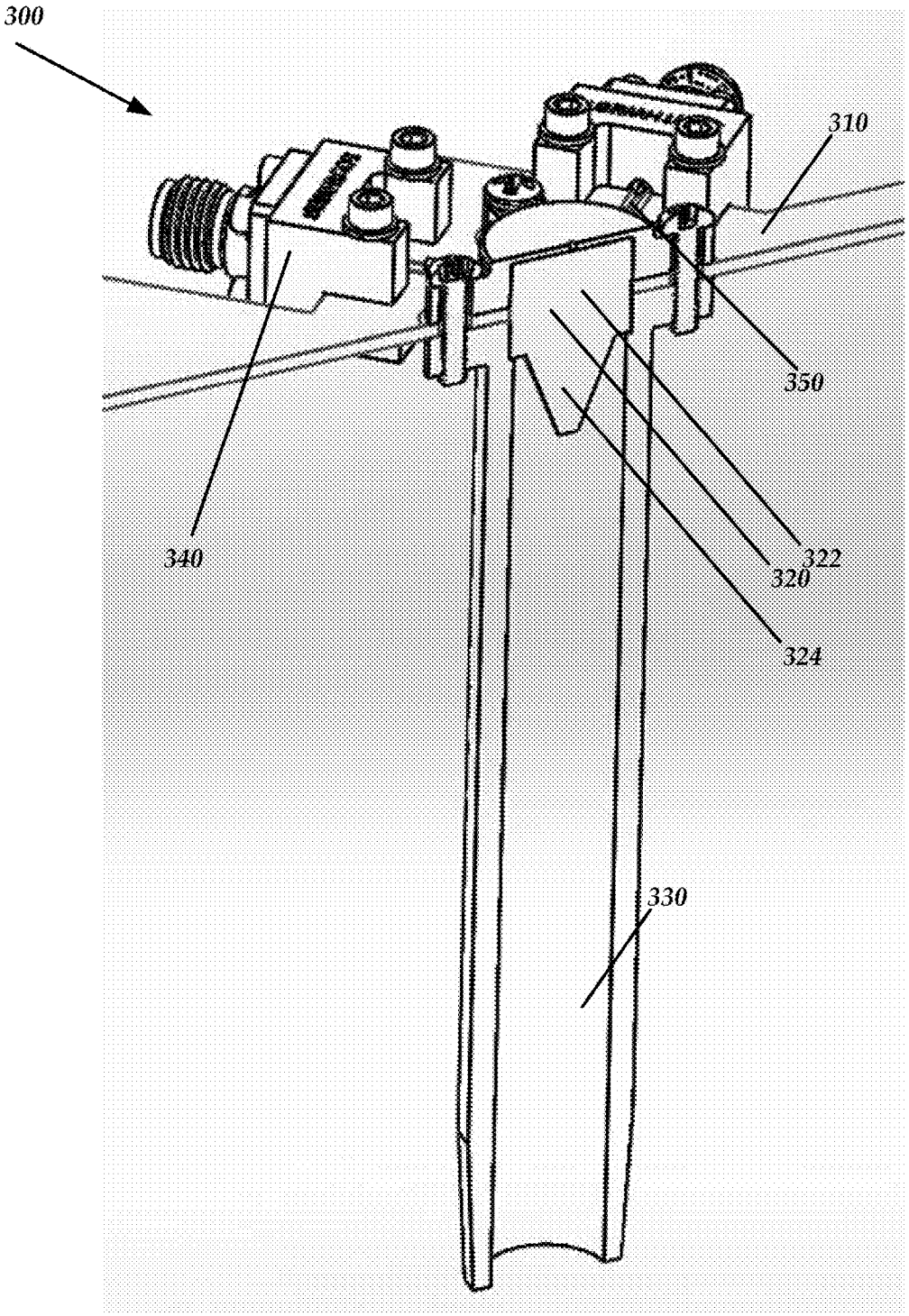
FIG. 3 is a top down view of an example device constructed in accordance with the present disclosure.

Turning now to FIG. 3, FIG. 3 is exemplary view of the device 300 which provides an enlarged, more detailed perspective view of a portion of FIG. 2. Specifically, FIG. 3 depicts a waveguide having a circular waveguide cross sectional area 330 and a square transition waveguide cross sectional area 320 comprising a dielectric block 322. As described previously, the square transition waveguide cross sectional area 320 may include a conical shape with a tapered end 324, which allows for the gentler transition of signals as they pass through the waveguide cross sectional areas which differ from each other. The gentler transition of signals in turn provides higher isolation. The device 300 also includes two coaxial connectors 340 to the PCB. The device 300 is not limited to the number of components as depicted in FIG. 3.

Figure 4:
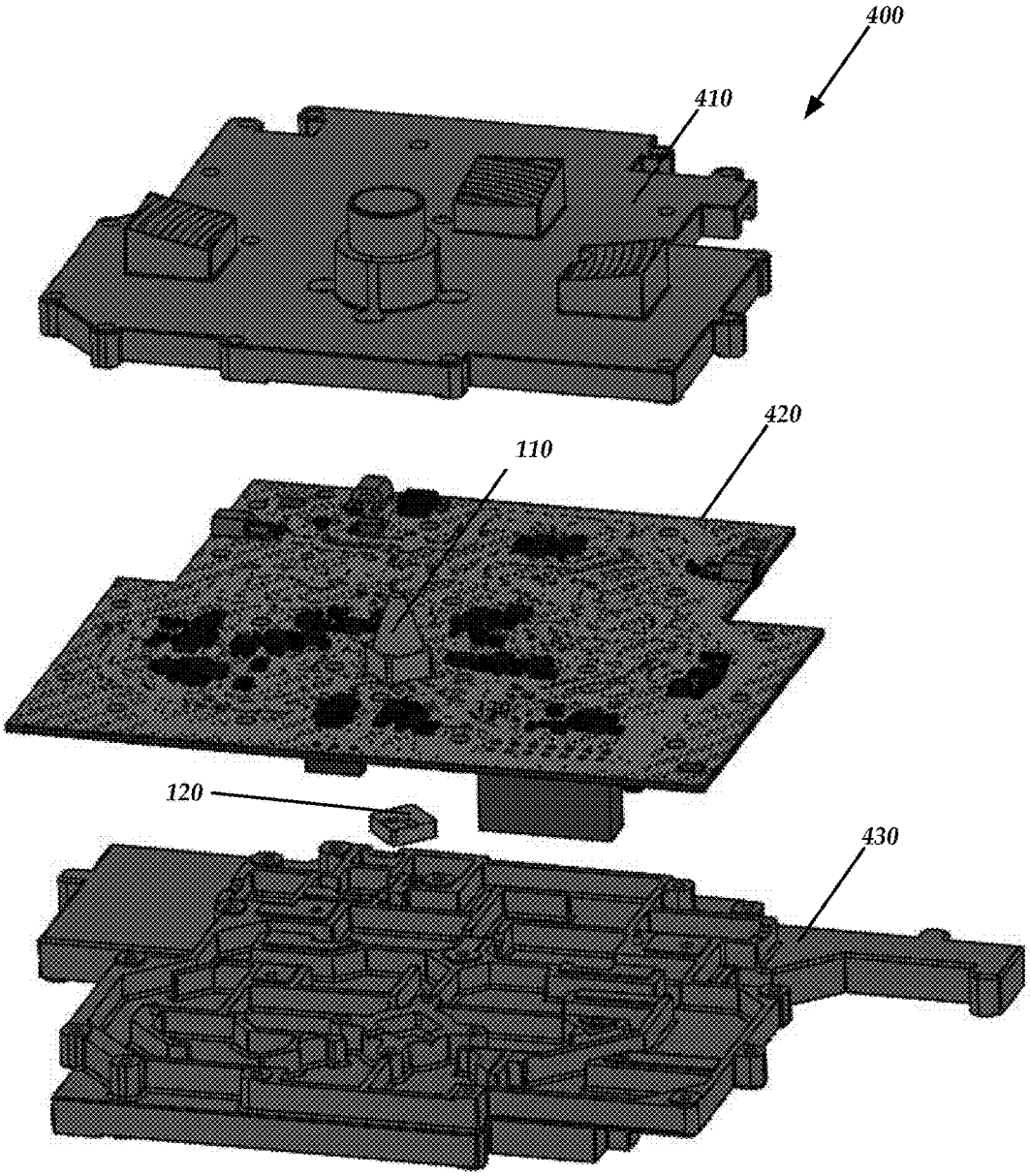
FIG. 4 is a cross sectional assembly view of an example device constructed in accordance with the present disclosure.

FIG. 4 is a cross sectional assembly view of a device 400. As mentioned earlier, FIG. 4 shows a printed circuit board (PCB) 420 that is sandwiched in between the circular waveguide cross sectional area 110 and the square transition waveguide cross sectional area 120. When constructed, the circular waveguide cross sectional area 110 and the square transition waveguide cross sectional area 120 can provide a smooth, easier transition as described above. The device 400 also comprises a top layer 410 and a bottom layer 430 which hold the assembly of the PCB and the components of the device 400 together.

Figure 5:
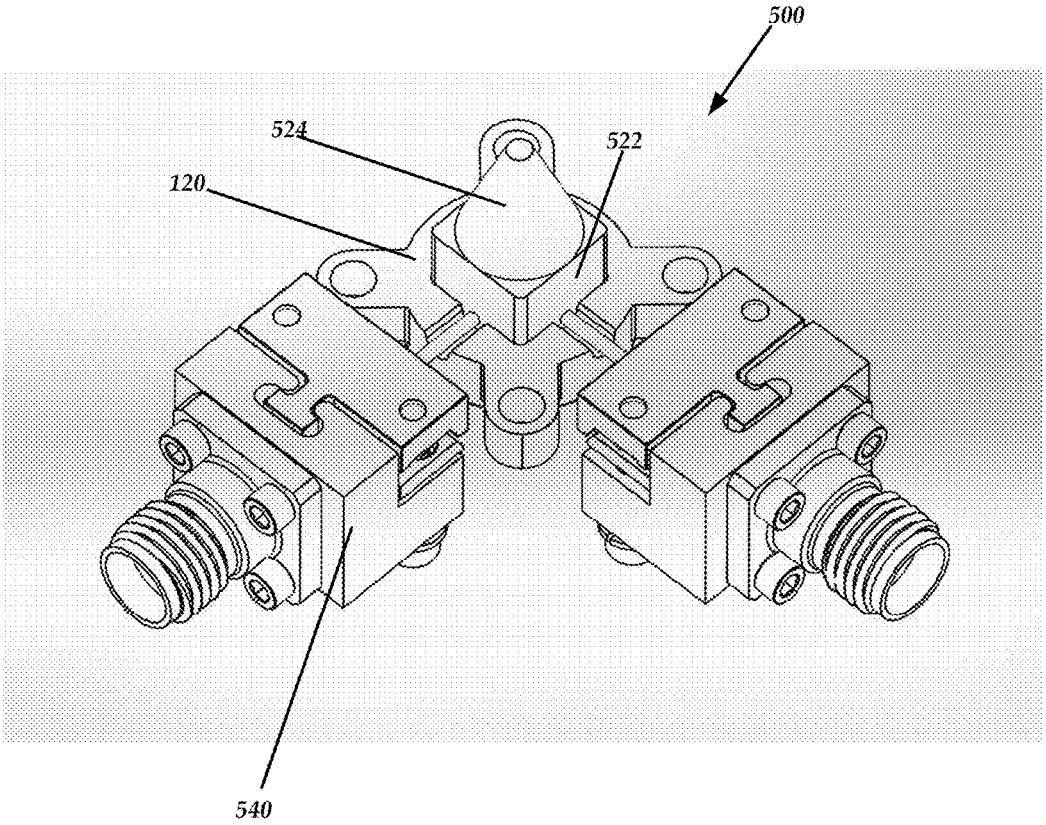
FIG. 5 is a perspective view of an example device constructed in accordance with the present disclosure.

FIG. 5 is a perspective view of an example device 500 in accordance with some embodiments of the present disclosure. Referring to FIGS. 1A, 1B and 5, the device 500 comprises a waveguide having a circular (cylindrical) waveguide cross sectional area 110 and a square transition waveguide cross sectional area 120. The square transition section 120 may include a square waveguide cross sectional area 522 with a conical shape waveguide cross section 524 mounted on it or otherwise coupled to it. The square transition waveguide cross-sectional area 120 may also include one or more connectors 540. The device 500 can include additional or fewer components than those illustrated.

The coaxial connectors 540 are connectors to the PCB, and they can launch signals into the PCB (not shown in FIGS. 1A and 1B). The PCB is preferably sandwiched between the circular waveguide cross sectional area 110 and the square transition waveguide cross sectional area 120.

Figure 6:
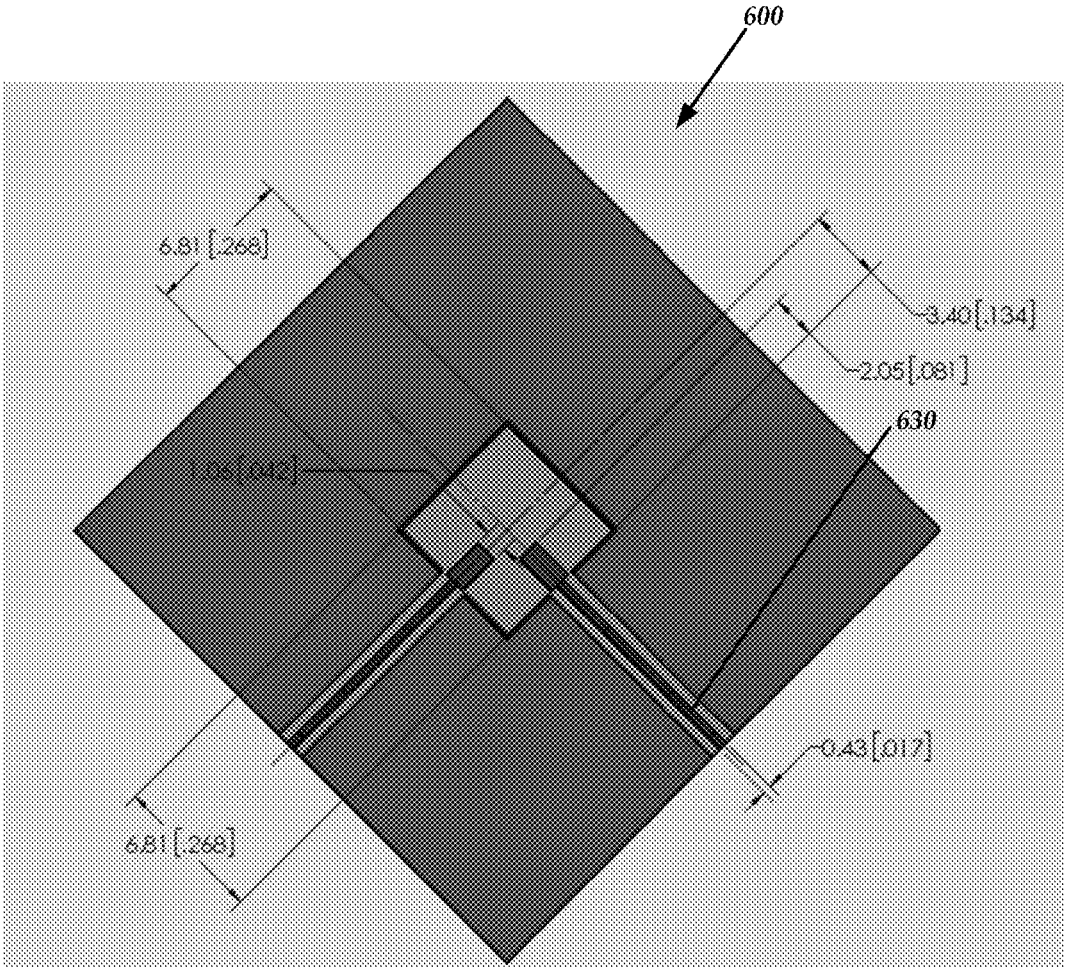
FIG. 6 is a top down view of an example device constructed in accordance with the present disclosure.

FIG. 6 is a top down view of a dielectric substrate 600 in accordance with some embodiments of the present disclosure. As discussed briefly above, probes can be printed on a printed circuit board as depicted in FIG. 6. It should be noted that for purposes of the present disclosure, wider probes having a triangular shape or a squatty appearance can have much more bandwidth than a skinny probe at the same overall length.

In an alternative embodiment, the addition of dielectric material could be applied to a coaxial feed transmission, thereby eliminating the need for a PCB altogether. In other words, instead of having coaxial transmissions that interface and transition signals into a PCB, one could bring a coaxial cable up through the wall of the waveguide, put it with a different connector for the dielectric substrate, strip out the PCB and show the connector.

While this technology is susceptible of embodiment in many different forms, there is shown in the drawings and will herein be described in detail several specific embodiments with the understanding that the present disclosure is to be considered as an exemplification of the principles of the technology and is not intended to limit the technology to the embodiments illustrated.

The terminology used herein is for the purpose of describing particular embodiments only and is not intended to be limiting of the technology. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It will be understood that like or analogous elements and/or components, referred to herein, may be identified throughout the drawings with like reference characters. It will be further understood that several of the figures are merely schematic representations of the present disclosure. As such, some of the components may have been distorted from their actual scale for pictorial clarity.

While this technology is susceptible of embodiment in many different forms, there is shown in the drawings and has been described in detail several specific embodiments with the understanding that the present disclosure is to be considered as an exemplification of the principles of the technology and is not intended to limit the technology to the embodiments illustrated.

Although the terms first, second, etc. may be used herein to describe various elements, components, regions, layers and/or sections, these elements, components, regions, layers and/or sections should not necessarily be limited by such terms. These terms are only used to distinguish one element, component, region, layer or section from another element, component, region, layer or section. Thus, a first element, component, region, layer or section discussed below could be termed a second element, component, region, layer or section without departing from the teachings of the present disclosure.

The terminology used herein is for the purpose of describing particular embodiments only and is not intended to be necessarily limiting of the disclosure. As used herein, the singular forms "a," "an" and "the" are intended to include the plural forms as well, unless the context clearly indicates otherwise. The terms "comprises," "includes" and/or "comprising," "including" when used in this specification, specify the presence of stated features, integers, steps, operations, elements, and/or components, but do not preclude the presence or addition of one or more other features, integers, steps, operations, elements, components, and/or groups thereof.

Example embodiments of the present disclosure are described herein with reference to illustrations of idealized embodiments (and intermediate structures) of the present disclosure. As such, variations from the shapes of the illustrations as a result, for example, of manufacturing techniques and/or tolerances, are to be expected. Thus, the example embodiments of the present disclosure should not be construed as necessarily limited to the particular shapes of regions illustrated herein, but are to include deviations in shapes that result, for example, from manufacturing.

Any and/or all elements, as disclosed herein, can be formed from a same, structurally continuous piece, such as being unitary, and/or be separately manufactured and/or connected, such as being an assembly and/or modules. Any and/or all elements, as disclosed herein, can be manufactured via any manufacturing processes, whether additive manufacturing, subtractive manufacturing and/or other any other types of manufacturing. For example, some manufacturing processes include three dimensional (3D) printing, laser cutting, computer numerical control (CNC) routing, milling, pressing, stamping, vacuum forming, hydroforming, injection molding, lithography and/or others.

Any and/or all elements, as disclosed herein, can include, whether partially and/or fully, a solid, including a metal, a mineral, a ceramic, an amorphous solid, such as glass, a glass ceramic, an organic solid, such as wood and/or a polymer, such as rubber, a composite material, a semiconductor, a nano-material, a biomaterial and/or any combinations thereof. Any and/or all elements, as disclosed herein, can include, whether partially and/or fully, a coating, including an informational coating, such as ink, an adhesive coating, a melt-adhesive coating, such as vacuum seal and/or heat seal, a release coating, such as tape liner, a low surface energy coating, an optical coating, such as for tint, color, hue, saturation, tone, shade, transparency, translucency, non-transparency, luminescence, anti-reflection and/or holographic, a photo-sensitive coating, an electronic and/or thermal property coating, such as for passivity, insulation, resistance or conduction, a magnetic coating, a water-resistant and/or waterproof coating, a scent coating and/or any combinations thereof.

Unless otherwise defined, all terms (including technical and scientific terms) used herein have the same meaning as commonly understood by one of ordinary skill in the art to which this disclosure belongs. The terms, such as those defined in commonly used dictionaries, should be interpreted as having a meaning that is consistent with their meaning in the context of the relevant art and should not be interpreted in an idealized and/or overly formal sense unless expressly so defined herein.

Furthermore, relative terms such as "below," "lower," "above," and "upper" may be used herein to describe one element's relationship to another element as illustrated in the accompanying drawings. Such relative terms are intended to encompass different orientations of illustrated technologies in addition to the orientation depicted in the accompanying drawings. For example, if a device in the accompanying drawings is turned over, then the elements described as being on the "lower" side of other elements would then be oriented on "upper" sides of the other elements. Similarly, if the device in one of the figures is turned over, elements described as "below" or "beneath" other elements would then be oriented "above" the other elements. Therefore, the example terms "below" and "lower" can, therefore, encompass both an orientation of above and below.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the present disclosure in the form disclosed. Many modifications and variations will be apparent to those of ordinary skill in the art without departing from the scope and spirit of the present disclosure. Exemplary embodiments were chosen and described in order to best explain the principles of the present disclosure and its practical application, and to enable others of ordinary skill in the art to understand the present disclosure for various embodiments with various modifications as are suited to the particular use contemplated.

While various embodiments have been described above, it should be understood that they have been presented by way of example only, and not limitation. The descriptions are not intended to limit the scope of the technology to the particular forms set forth herein. Thus, the breadth and scope of a preferred embodiment should not be limited by any of the above-described exemplary embodiments. It should be understood that the above description is illustrative and not restrictive. To the contrary, the present descriptions are intended to cover such alternatives, modifications, and equivalents as may be included within the spirit and scope of the technology as defined by the appended claims and otherwise appreciated by one of ordinary skill in the art. The scope of the technology should, therefore, be determined not with reference to the above description, but instead should be determined with reference to the appended claims along with their full scope of equivalents.

What is claimed is:

1. A device, comprising:

a dielectric substrate;

an electrical feed;

an antenna mounted onto the dielectric substrate and connected to the electrical feed, the antenna having a substantially square shape; and a waveguide mounted onto the dielectric substrate so as to enclose around a periphery of the antenna and contain radiation produced by the antenna along a path that is coaxial with a centerline of the waveguide, the waveguide comprising: a first portion comprising a first cross sectional area that is substantially polygonal that transitions to a second cross sectional area that is substantially conical, wherein a shape of the radiation produced by the antenna is altered by the first portion as the radiation propagates through the first portion, the waveguide further comprising a second portion comprising an elongated tubular member coupled with the first portion.

2. The device according to claim 1, wherein the first cross sectional area is cubic.

3. The device according to claim 2, wherein the first cross sectional area further comprises a tapered end.

4. The device according to claim 1, wherein the second cross sectional area is a frusto-conical in shape.

5. The device according to claim 1, wherein multiple dielectric pieces are used in the first and second cross sectional areas.

6. The device according to claim 1, wherein the first portion comprises an elongated connector that couples with the electrical feed, the elongated connector extending normally to a sidewall of the first cross sectional area.

7. The device according to claim 6, further comprising a top layer that comprises the second portion, wherein the top layer covers the dielectric substrate.

8. A device, comprising:

a dielectric substrate having one or more probes;

an electrical feed;

a square antenna mounted onto the dielectric substrate and connected to the electrical feed; and a waveguide mounted onto the dielectric substrate so as to enclose around a periphery of the square antenna and contain radiation produced by the antenna along a path that is coaxial with a centerline of the waveguide, the waveguide comprising a first portion having both a polygonal cross sectional area and a conical cross sectional area, the waveguide further comprising a tubular member that encloses the first portion.

9. The device according to claim 8, wherein the one or more probes comprise wire components soldered directly onto the dielectric substrate and pressed in with a dielectric block.

10. The device according to claim 8, wherein the one or more probes are inserted into the dielectric substrate.

11. The device according to claim 8, wherein the one or more probes have been printed onto the dielectric substrate.

12. The device according to claim 8, further comprising a top layer that comprises the tubular member, wherein the top layer covers the dielectric substrate and the first portion.

13. The device according to claim 12, wherein the first portion of the waveguide transitions a shape of the radiation from a square shape to a circular shape.

14. The device according to claim 8, wherein multiple dielectric pieces are used in the polygonal cross sectional area and the conical cross sectional area of the first portion of the waveguide.

15. The device according to claim 8, wherein the one or more probes are three dimensional.

16. The device according to claim 8, further comprising a top layer that comprises the tubular member, wherein the top layer covers the dielectric substrate allowing the tubular member to encircle the square antenna and the waveguide.

17. The device according to claim 8, wherein the dielectric substrate further comprises a dielectric block which supports and positions the one or more probes in the dielectric substrate.

* * * * *